US009605474B1

(12) United States Patent
McCauley

(10) Patent No.: US 9,605,474 B1
(45) Date of Patent: Mar. 28, 2017

(54) GARAGE DOOR SCREEN

(71) Applicant: Glen Roy McCauley, Pittsburg, CA (US)

(72) Inventor: Glen Roy McCauley, Pittsburg, CA (US)

( * ) Notice: Subject to any disclaimer, the term of this patent is extended or adjusted under 35 U.S.C. 154(b) by 340 days.

(21) Appl. No.: 13/998,181

(22) Filed: Oct. 8, 2013

Related U.S. Application Data

(63) Continuation-in-part of application No. 13/815,410, filed on Feb. 27, 2013.

(51) Int. Cl.

| | |
|---|---|
| ***A47H 1/00*** | (2006.01) |
| ***E06B 3/32*** | (2006.01) |
| ***E06B 9/08*** | (2006.01) |
| ***E06B 9/02*** | (2006.01) |

(52) U.S. Cl.
CPC . *E06B 9/08* (2013.01); *E06B 9/02* (2013.01)

(58) Field of Classification Search
CPC ..... E06B 2009/546; E06B 9/54; E06B 9/52
USPC ..... 160/27, 28, 90, 265, 89
See application file for complete search history.

(56) References Cited

U.S. PATENT DOCUMENTS

| | | | | |
|---|---|---|---|---|
| 618,830 A * | 2/1899 | Barr | E06B 9/54 160/27 |
| 1,053,294 A * | 2/1913 | Karlss | E06B 9/54 160/122 |
| 4,653,566 A * | 3/1987 | Miale | E06B 9/54 160/113 |
| 5,787,952 A * | 8/1998 | Wegner | E06B 9/54 160/100 |
| 2006/0037716 A1* | 2/2006 | Hatten | E06B 9/54 160/113 |

* cited by examiner

*Primary Examiner* — Katherine Mitchell
*Assistant Examiner* — Jeremy Ramsey
(74) *Attorney, Agent, or Firm* — Risto A. Rinne, Jr.

(57) ABSTRACT

An apparatus for use with an overhead garage door includes an extensible screen that is provided in a screen assembly that is embedded within opening provided in a garage floor. A pair of horizontal and vertical recesses are provided on opposite sides of the opening to secure the screen assembly within the opening. The screen is wound on a spring-biased center roller disposed in a cylinder of the screen assembly. A top of the screen is secured to a strip. A pair of angled plates are disposed on opposite sides of the strip and are hingedly attached to the cylinder. When the garage door is lowered and extension of the screen is desired, a pair of pivot assemblies provided on the door bottom engage with the strip. As the door is raised, the strip and screen are extended from the screen assembly to cover an opening into the garage.

15 Claims, 5 Drawing Sheets

GARAGE DOOR SCREEN

This patent application is a Continuation-in-Part that claims the Benefit of Priority of patent application Ser. No. 13/815,410 which was filed on Feb. 27, 2013 by the same inventor, Glen Roy McCauley entitled "Garage Door Sareen," and wherein the entire content of patent application Ser. No. 13/815,410 is included herein, by way of reference.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to overhead garage doors and, more particularly, to a screen door for cooperative use with an overhead type of garage door.

Access to most garages is provided by some type of a paneled overhead garage door that includes a plurality of hinged panels that are raised along a pair of parallel spaced-apart tracks disposed on opposite sides of the garage door. The overhead garage door may be raised manually or an automatic remote-controlled garage door opening mechanism may be used. As used herein, the term "garage door" refers to either a manually activated or an automatically controlled paneled overhead garage door of any width or height.

Garages are used for many purposes. For example, automobiles, lawnmowers, shop tools and all manner of storage items are often placed in the interior of a garage. However, garages are also used for purposes other than the storage of vehicles or other objects, therein.

For example, people may use their garage as an exercise room. Various pieces of exercise equipment such as a treadmill, a stationary bicycle or a set of free-weights may be placed within the garage to provide a gym-type environment at home. By having the garage as an exercise room, the garage provides a convenient location for people to work out at any time of the day.

The garage may also be used as a workshop or a hobby shop. The homeowner may work on a vehicle, do woodworking or build models within the garage.

Additionally, people may use their garage as a children's playroom. The converted playroom can be filled with various toys and games which, in turn, can lessen the amount of clutter within a child's bedroom. The children can utilize the garage as a space where they can play with the toys and games or create arts and craft projects that may otherwise be unable to complete within an interior of the home where there is insufficient room.

Other people use the garage interior for socializing. A larger generally open area for interacting is provided by the garage interior space. For example, during the rain when a barbeque or outdoor gathering is planned, guests may congregate in the garage to socialize while enjoying an outdoor feeling from the open garage door while still being protected from the rain.

Even if no rain is forthcoming, the large open area of the garage may be preferred for informal get-togethers. An old refrigerator and a folding table for serving food and drink, dining, or playing cards may be all that is needed to convert a garage into an effective gathering area for guests. Some people also include a television in their garage for watching baseball or football games. Families may also use the garage as a "family room" where everyone can gather to watch movies or shows on the television together.

Even if one or more automobiles are normally stored in the garage, they can easily be removed when desired for socializing.

However, there are disadvantages to having an open garage door. It is easy for meat-eating bees to enter. Their presence is especially annoying and may even be alarming to many guests. Mosquitos can similarly enter and adversely affect the use of the area. While exclusion of the entry of all bees and mosquitos may not be possible, it is desirable to deter the greater amount from entering, as would occur if the garage door were opened without any resistance to their entry.

Similarly, unwanted cats and dogs may enter the garage at will. People gathering within the garage are likely to be bothered by unwanted cats or dogs while they are eating or socializing in the garage. The unwanted cats or dogs may beg for food or cause other undesired nuisances.

The garage may also be a place where a dog or a cat may be kept while the homeowner is away from home. The dog or cat may be placed within the garage while the homeowner goes to work or leaves the home to run errands. It is also desirable to keep the unwanted cats or dogs out of the garage while a pet is within the garage. The unwanted animal may attack the pet or try to eat the food that has been provided for the pet.

In addition to keeping out unwanted animals, there is a need to supply air flow and ventilation for the pet while it is kept within the garage. On a hot day without ventilation, ambient temperatures within a closed garage can soar to high levels which may place the animal's health at risk.

Presently when leaving a pet in the garage, the garage door is typically left partially open to provide ventilation while the pet is kept within the garage. The door is partially raised to a height that will not permit the pet to escape from the garage, which is generally a few inches. However, unwanted animals may still manage to enter the small gap between the garage door and the floor of the garage. As mentioned previously, the unwanted animal may disturb the pet inside, eat, or contaminate the pet's food.

It is desirable to provide a garage door screen that can be raised to any desired height. A small opening is preferred when it is windy, snowing, or gusty rains are falling. This is to prevent excessive outside air from entering the garage interior which might make it uncomfortably cold or to prevent excessive moisture from entering. Alternately when the weather is warm, it is desirable to raise the garage door screen into a more fully extended position to maximize the amount of air flow into and out of the garage.

Additionally, people passing by may be curious as to what contents may be stored within the garage. The garage door being partially open provides potential intruders with an opportunity to look into an interior of the garage. If a thief finds something of interest he may break in then or later. Accordingly, it is preferable to limit viewing of the contents in the garage under certain situations. For example, this need may be more acute in certain neighborhoods.

Furthermore, the people using their garage for any of the aforementioned purposes may also enjoy privacy while still enjoying the benefit of having the garage door open. Should a person be exercising or watching a sporting game or movie in the garage with the door open, it is likely that the person would prefer a way to provide privacy and prevent being seen by people and cars passing by the open garage door. They may also want to decrease the amount of light entering into the garage when, for example, they are watching television on a brightly-lit day.

While the use of a screen door is preferred, there are numerous problems With existing designs. Prior solutions require a user to manually secure a bottom of a screen to eye-hooks that are embedded in the garage floor. This requires manipulation and bending down to secure or release the bottom of the screen from engagement with the floor. Additionally, the elevated eye-hooks pose a significant ongoing tripping hazard.

The embedded eye-hooks of prior garage door screens extend upward from the garage floor and are also not designed to withstand the weight of a vehicle passing over the eye-hooks embedded in the garage floor. If the eye-hooks are run over by the tires, they may be bent from the weight of the vehicle, and furthermore, they may cause damage to the vehicle's tires.

Other prior art garage door screens require the screen portion to be attached directly to the garage door or frame of the garage door opening. This adds additional weight and bulk to the garage door, which is undesirable. Also, some homeowners or business owners may not want to see the screen enclosure when the screen is not in use.

Embedding the entire garage door screen within the garage floor would provide a convenient way to store the garage door screen when it is not in use. Accordingly, there is a need to provide a mounting system for a garage door screen that is completely housed within the garage floor.

The need for ventilation of a garage interior, control of moisture entry, prevention of animals or people from entering, limit visibility of the garage interior apply also to commercial uses. For example, a commercial garage interior that is used for the repair of automobiles, or any other commercial purpose, would also stand to benefit from the use of a garage door screen.

Accordingly, there exists today a need for a garage door screen that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Screens for garage doors are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 8,016,014 to Crider, et al., that issued on Sep. 13, 2011;

U.S. Pat. No. 7,832,451 to Miller, et al., that issued on Nov. 16, 2010;

U.S. Pat. No. 7,509,990 to Milligan, that issued on Mar. 31, 2009;

U.S. Pat. No. 6,557,614 to Lampers, that issued on May 6, 2003;

U.S. Pat. No. 6,289,963 to Vaske, that issued on Sep. 18, 2001;

U.S. Pat. No. 6,098,698 to King-Darr, that issued on Aug. 8, 2000;

U.S. Pat. No. 6,059,007 to Tomita, that issued on May 9, 2000;

U.S. Pat. No. 4,653,566 to Miale, that issued on Mar. 31, 1987;

U.S. Pat. No. 3,421,568 to Youngs, that issued on Jan. 14, 1969;

U.S. Pat. No. 2,825,400 to Poulsen, that issued on Mar. 4, 1958;

U.S. Pat. No. 2,605,823 to Lockhart, that issued on Aug. 5, 1952;

U.S. Pat. No. 2,560,440 to Heeren, that issued on Jul. 10, 1951;

U.S. Pat. No. 2,243,790 to Blood, that issued on May 27, 1941;

U.S. Pat. No. 2,239,006 to Krywonis, that issued on Apr. 22, 1941;

U.S. Pat. No. 2,012,124 to Feige, that issued on Aug. 20, 1935;

U.S. Pat. No. 1,803,674 to Nicholson, that issued on May 5, 1931;

U.S. Pat. No. 1,800,080 to Kaminski, et al., that issued on Apr. 7, 1931;

U.S. Pat. No. 1,738,131 to Wolzenski, et al., that issued on Dec. 3, 1929;

U.S. Pat. No. 1,660,225 to Haftel, that issued on Feb. 21, 1928;

U.S. Pat. No. 1,544,702 to Trifari, that issued on Jul. 7, 1925;

U.S. Pat. No. 1,527,038 to Fasson, that issued on Feb. 17, 1925;

U.S. Pat. No. 1,458,617 to Smidt, that issued on Jun. 12, 1923;

U.S. Pat. No. 1,223,934 to Charlton, that issued on Apr. 24, 1917;

U.S. Pat. No. 912,104 to Flora, that issued on Feb. 9, 1909;

U.S. Pat. No. 681,249 to Nevins, that issued on Aug. 27, 1901;

U.S. Pat. No. 611,924 to Monroe, that issued on Oct. 4, 1898; and

U.S. Pat. No. 528,992 to Sholder, that issued on Nov. 13, 1894.

And including U.S. Patent Application Publications:

U.S. Patent Application Publication No. 2011/0315328 to Hazel, that published on Dec. 29, 2011;

U.S. Patent Application Publication No. 2006/0037716 to Hatten, that published on Feb. 23, 2006; and U.S. Patent Application Publication No. 2004/0020607 to Aguirre, Jr., et al., that published on Feb. 5, 2004.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a garage door screen that is easy to operate.

It is also an important object of the invention to provide a garage door screen that includes an extensible screen that is detachably-attachable with respect to a bottom end of an overhead garage door.

Another object of the invention is to provide a garage door screen that includes a generally rectangular-shaped main opening which is created in a freshly poured concrete floor prior to installation of the garage door screen.

Still another object of the invention is to provide a garage door screen that includes a main screen assembly that is embedded in a rectangular main opening provided in a garage floor.

Still yet another object of the invention is to provide a garage door screen that includes a main screen assembly that is disposed in a rectangular main opening provided in a garage floor and wherein the main screen assembly is secured within a pair of recesses that are provided in the rectangular main opening to prevent lateral movement or rotation of the main screen assembly, therein.

Yet another important object of the invention is to provide a garage door screen that includes a main screen assembly that is disposed in an opening which extends below a surface of a garage floor and wherein the main screen assembly can be removed for maintenance and servicing when desired.

Still yet another important object of the invention is to provide a garage door screen that includes a main screen assembly and wherein the main screen assembly includes an extensible screen which is detachably-attachable with respect to a lower portion of an overhead garage door and wherein the extensible screen can be extended any desired amount corresponding to a height the garage door is raised.

A first continuing object of the invention is to provide a garage door screen that includes a pivot assembly which is detachably-attachable with respect to a lower portion of an overhead garage door, and wherein the pivot assembly engages with a longitudinal strip of an extensible screen, and wherein the extensible screen is contained in a main screen assembly that is embedded in a garage floor.

A second continuing object of the invention is to provide a garage door screen that includes an extensible screen that is detachably-attachable with respect to a lower portion of an overhead garage door and, when the garage door screen is extended, it provides ventilation to a garage interior.

A third continuing object of the invention is to provide a garage door screen that can be attached, or retrofitted, to an existing overhead garage door.

A fourth continuing object of the invention is to provide a garage door screen that can be included as a component part of a newly manufactured overhead garage door.

A fifth continuing object of the invention is to provide a garage door screen that includes a garage door screen that can be embedded, or retrofitted, into an existing garage floor.

A sixth continuing object of the invention is to provide a garage door screen that includes an extensible screen that can, when desired, be raised from a main screen assembly embedded within a garage floor.

A seventh continuing object of the invention is to provide a garage door screen that includes an extensible screen that can, when desired, provide a screen barrier that extends substantially across the width of a garage door and vertically to whatever height the garage door is opened.

An eighth continuing object of the invention is to provide a garage door screen that includes an extensible screen that includes a material which substantially prevents passersby's from looking into an interior of a garage while still allowing people within the interior of the garage to be able to look out of the garage.

A ninth continuing object of the invention is to provide a garage door screen that includes a main screen assembly that includes a pair of angled plates that are sufficiently durable and able to withstand the weight of a vehicle passing over an upper surface of each of the angled plates.

A tenth continuing object of the invention is to provide a garage door screen that can be used with either a residential or a commercial type of overhead garage door.

Briefly, a garage door screen that is constructed in accordance with the principles of the present invention has a generally rectangular-shaped main opening provided in a garage floor of either a home or a commercial garage. The main opening is formed in a poured concrete slab or provided in an existing garage floor. Forms of any desired material are used, as is well known in the concrete arts, and removed after the cement has set for new construction. The garage floor surrounds a top surface of the main opening. A first vertical recess is provided on a first side of the main opening. A first horizontal recess is connected to a bottom of the first vertical recess. Together the first vertical recess and the first horizontal recess form a first "L"-shaped recess on the first side of the main opening. A second vertical recess is provided on an opposite second side of the main opening. A second horizontal recess that is connected to a bottom of the second vertical recess is also provided to form a second "L"-shaped recess similar to the first "L"-shaped recess. A center of the first and second vertical and horizontal recesses are located at an approximate center of a width of the main opening. A main screen assembly is inserted into the main opening. The main screen assembly includes a cylinder housing which houses a length of a rolled extensible and retractable screen. The screen includes any desired flexible material, such as synthetic or aluminum screening, cloth fabric or synthetic material, one-way viewing material, or other sheet material, as desired. The cylinder includes a square first protrusion that extends outward from an approximate center of a first face of the cylinder. A square second protrusion extends outward from an opposite or distal second end of the cylinder. A second face of the cylinder surrounds the second protrusion. The second protrusion is disposed at or near a center of the second face. The first and second protrusions of the cylinder are aligned with a top of the first and second vertical recesses of the main opening and urged downward. The cylinder of the main screen assembly is then urged forward fully into the first and second horizontal recesses. This ensures that an opening slot which extends along a longitudinal length of the cylinder of the main screen assembly always faces upward. A first retaining block is urged down into the first vertical recess and a second retaining block is urged down into the second vertical recess. The first and second retaining blocks secure the main screen assembly in a center of the main opening and prevent the cylinder housing from rotating during use. A first ring is preferably attached to an upper surface of the first retaining block to facilitate removal of the first retaining block from the first vertical recess. A second ring is preferably attached to an upper surface of the second retaining block to facilitate removal of the second retaining block from the second vertical recess. The main screen assembly is occasionally removed from the main opening for cleaning or maintenance. To remove the main screen assembly, a first angled plate and a second angled plate that are each hingedly attached to the cylinder are raised to a vertical position. This allows grasping of the first ring and removal of the first retaining block from the first vertical recess by lifting the first retaining block upward. Similarly, the second ring is grasped and the second retaining block is urged upward and out of the second vertical recess. The main screen assembly is then urged toward both the first and second vertical recesses, as far as possible, and then lifted up through the first and second vertical recesses and out of the main opening. Maintenance or servicing of the main screen assembly can then be performed, as necessary. A top of the extensible screen is attached to a bottom of a strip along an entire longitudinal length of the strip. When the screen is disposed in a fully retracted position, the strip is disposed over and covers the slot of the cylinder. A first longitudinal seal is attached to the bottom of the strip along a first edge, thereof, and extends along the entire longitudinal length of the strip. A second longitudinal seal is attached to the bottom of the strip along an opposite second edge. The second longitudinal seal also extends along the entire longitudinal length of strip. When the screen is in fully retracted position, the first longitudinal seal bears against an upper surface of the first angled plate. The second longitudinal seal bears against an upper surface of the second angled plate. Both the first and second angled plates are preferably made of steel, however any preferred material may be used. An upper edge of each of the first and second angled plates is hingedly attached to the cylinder of the main screen assembly on opposite sides of the slot. A third longitudinal seal is attached to a bottom of the first angled plate along a lower edge, thereof. A fourth longitudinal seal is attached to a bottom of the second angled plated along a lower edge, thereof. When the screen is in the fully retracted position, the first, second, third, and fourth longitudinal seals provide a highly water-resistant barrier for the garage door screen that minimizes water entry into the main opening area. When it is desired to raise the screen, the garage door is lowered fully and a lower portion of the garage door is mechanically attached to the strip. According to one possible embodiment, a first and a second keyhole-shaped main opening are provided through a top of the strip. A pair of pivot assemblies are each installed into the lower portion of the garage door. Each pivot assembly includes a retaining member which enters through both the first and second main keyhole openings. A solenoid is included as part of the pivot assembly that is energized when garage door is disposed at a fully lowered position. A pivot arm pivots about a top pivot hinge causing the retaining member of both pivot assemblies to pass under a first and then under a second smaller keyhole opening. As the garage door is raised, each retaining member engages with an underside of the second smaller keyhole opening of the strip and urges the strip upward as the garage door moves upward (i.e., opens). Raising of the strip also causes the screen to raise as the screen is progressively unwound off of a center roller in the cylinder. To return the screen into the main assembly, the garage door is lowered. A spring-biased center roller rotates, thereby retracting the screen through the slot and back into an interior of the cylinder. When the garage door reaches the fully lowered position, the solenoid automatically disengages (i.e., is de-energized), thus causing the retaining member to pivot under the first and second main keyhole openings. If the garage door is then raised, the screen will remain in the fully retracted position. An existing garage floor can be cut to provide the main opening. If desired, a drain is provided proximate a bottom of the main opening to drain away any water that may accumulate, therein. Other methods for detachably-attaching the strip to the lower portion of the garage door are, of course, possible.

DETAILED DESCRIPTION OF THE INVENTION

Figure 1:
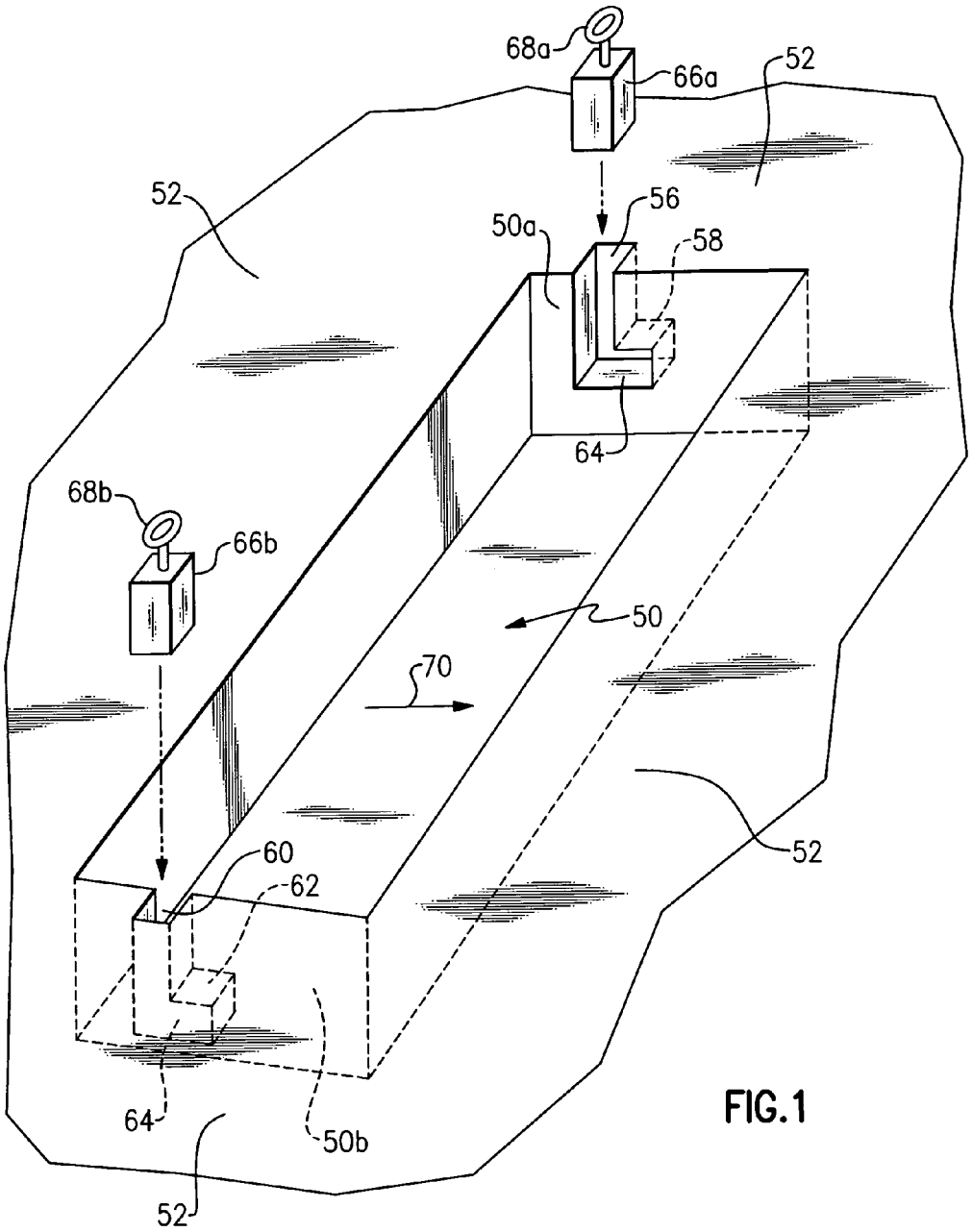
FIG. 1 is a view in perspective of a rectangular main opening provided in a garage floor.

Referring on occasion to all of the FIGURE drawings and now, in particular to FIG. 1, is shown a garage door screen, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The garage door screen 10 is preferably installed during construction of new homes or commercial garages (not shown).

The garage door screen 10 is fitted into a generally rectangular-shaped main opening, identified in general by reference numeral 50. The main opening 50 is provided in a garage floor 52 of either the home or the commercial garage. The main opening 50 is formed in a poured concrete slab of the garage floor 52 while the home or commercial garage is being constructed (i.e., built). The main opening 50 includes sufficient length, width, and depth to receive other components of the garage door screen 10, as described in greater detail, hereinafter.

To create the main opening 50 in the garage floor 52, forms of any desired material such as wood, plastic or Styrofoam are placed in the wet cement and removed after the cement has set. The cement of the garage floor 52 surrounds all sides of the main opening 50, and, if desired, the bottom of the main opening 50.

A first vertical recess 56 is provided on a first side 50*a* of the main opening 50. A first horizontal recess 58 is connected to a bottom of the first vertical recess 56. Together the first vertical recess 56 and the first horizontal recess 58 form a first "L"-shaped recess on the first side 50*a* of the main opening 50.

A second vertical recess 60 is provided on an opposite second side 50*b* of the main opening 50. A second horizontal recess 62 that is connected to a bottom of the second vertical recess 60 is also provided to form a second "L"-shaped recess that is similar to and parallel with respect to the first "L"-shaped recess. A center of the first and second horizontal recesses 58, 62 is located at an approximate center, as shown in general by reference numeral 64, of a width of the main opening 50.

Figure 2:
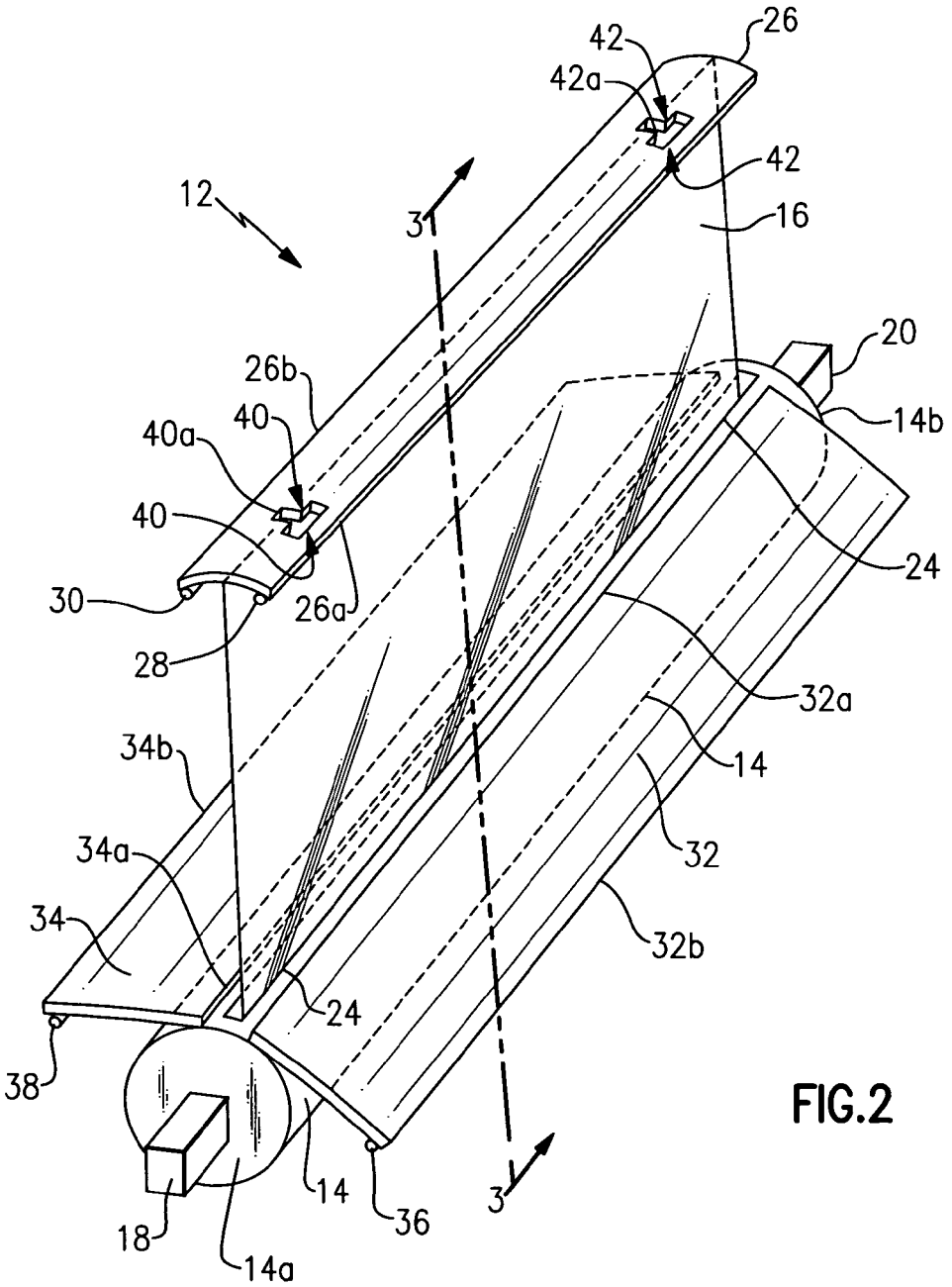
FIG. 2 is a view in perspective of a main screen assembly of a garage door screen.

Referring to FIG. 2, a main screen assembly, identified in general by the reference numeral 12, is shown prior to insertion within the main opening 50 provided in the garage floor 52. The main screen assembly 12 includes a cylinder 14. The cylinder 14 is preferably made from steel, however any desired material may be used.

The cylinder 14 houses a length of a rolled extensible and retractable screen 16. The screen 16 is shown partially extended from the cylinder 14. If desired, the cylinder 14 may instead include a rectangular shape or have any desired cross-section. A rectangular cross-sectional shape for a modified cylinder (not shown) could fit snugly in the main opening 50 and would not rotate, therein. The cylinder 14 preferably includes a square first protrusion 18 and an opposite square second protrusion 20. The first square protrusion 18 extends outward from an approximate center of a first face 14*a* of the cylinder 14. The second square protrusion 20 extends outward from a center of an opposite or distal second face 14*b* of the cylinder 14. The first and second square protrusions 18, 20 are an extension of the cylinder 14 and are preferably made from steel or from the same material that is used for the cylinder 14.

To insert the main screen assembly 12 into the main opening 50, the first and second square protrusions 18, 20 of the cylinder 14 are aligned with a top of the first and second vertical recesses 56, 60 provided in the main opening 50 and urged downward. The main screen assembly 12 is fully lowered until a bottom of the first square protrusion 18 rests on a bottom surface of the second horizontal recess 62 and a bottom of the second square protrusion 20 rests on a bottom surface of the first horizontal recess 58.

The cylinder 14 of the main screen assembly 12 is then urged fully forward, in the direction shown by arrow 70 (See FIG. 1), thereby placing the first and second square protrusions 18, 20 against the ends of first and second horizontal recesses 58, 62. If any upward force is then applied to the main screen assembly 12, such as when the screen 16 is extended upward, the first and second square protrusions 18, 20 disposed in the first and second horizontal recesses 58, 62 prevent lifting and retain the main screen assembly 12 within the main opening 50.

Properly aligning the first and second square protrusions 18, 20 within the first and second horizontal recesses 58, 62 ensures that a slot 24 provided along a longitudinal length of the cylinder 14 always faces upward.

Figure 3:
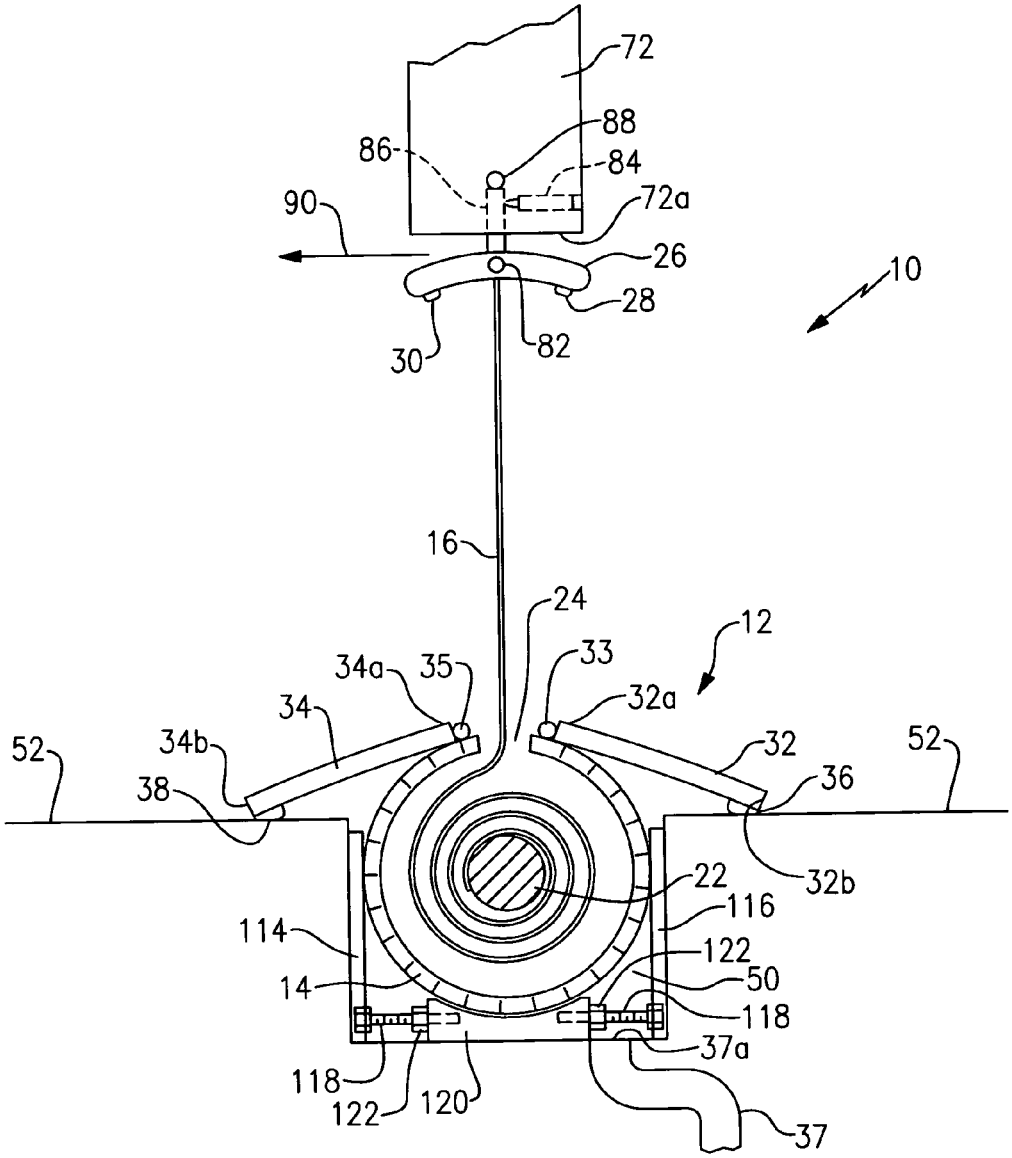
FIG. 3 is a cross-sectional view taken along the line 3-3 of FIG. 2 of the main screen assembly of the garage door screen.

Now referring also to FIG. 3, is shown a cross-sectional view of the main screen assembly 12 taken along line 3-3 in FIG. 2. An upper end of the screen 16 extends outward from the cylinder 14 and passes through the slot 24. An opposite bottom end of the screen 16 is attached to a spring-biased center roller 22 that is disposed within an interior of the cylinder 14. The upper end of the screen 16 is attached to a bottom of a strip 26 along an entire longitudinal length of the strip 26. As shown in FIG. 3, the screen 16 is disposed in a partially extended position. If the screen 16 were disposed in a fully extended position, more of the screen 16 would be visible above the slot 24 and the strip 26 would be elevated higher above the slot 24, as well. When the screen 16 is disposed in a fully retracted position, the strip 26 is disposed above and covers the slot 24 of the cylinder 14.

A first longitudinal seal 28 is attached to the bottom of the strip 26 along a first edge 26*a*, thereof, and extends along the entire longitudinal length of the strip 26. A second longitudinal seal 30 is attached to the bottom of the strip 26 along an opposite second edge 26*b*. The second longitudinal seal 30 also extends along the entire longitudinal length of strip 26.

When the screen 16 is in fully retracted position (i.e., the screen 16 is completely housed within the cylinder 14), the first longitudinal seal 28 bears against an upper surface of a first angled plate 32. The second longitudinal seal 30 bears against an upper surface of a second angled plate 34. Both the first and second angled plates 32, 34 are preferably made of steel, however any preferred material may be used.

When a vehicle (not shown) drives over the first and second angled plates 32, 34, that are disposed proximate the garage floor 52, the weight of vehicle is transferred through the main screen assembly 12 to the first and second square protrusions 18 and 20. This provides an important advantage over (all known) prior-art designs where the prior-art screws (not shown) are attached to a modified garage door (not shown). The embedded eye-hooks of prior art garage door screens extend upward from the garage floor 52 and are not designed to withstand the weight of the vehicle passing over the eye-hooks embedded in the garage floor 52. If the eye-hooks are run over by the tires, they may be bent from the weight of the vehicle, and furthermore, they may cause damage to the vehicle's tires. These potential problems are eliminated by the garage door screen 10.

The first and second angled plates 32, 34 provide a smooth surface for the vehicle to drive over and do not pose a potential tripping hazard as is likely with the embedded eye-hooks of prior art garage door screen designs.

It is desired that a commercial version of the garage door screen 10 that is to be used in a commercial garage (not shown) is engineered to withstand greater loading and more frequent vehicle passings over the first and second angled plates 32, 34.

An upper edge 32*a* of the first angled plate 32 is hingedly attached to the cylinder 14 by a first longitudinal hinge 33. An upper edge 34*a* of the second angled plate 34 is hingedly attached to the cylinder 14 by a second longitudinal hinge 35. The first and second longitudinal hinges 33, 35 are located on opposite sides of the slot 24. The first and second longitudinal hinges 33, 35 permit the first angled plate 32 and the second angled plate 34 to pivot either up or down.

A third longitudinal seal 36 is attached to a bottom of the first angled plate 32 proximate a first lower edge 32*b*, thereof. A fourth longitudinal seal 38 is attached to a bottom of the second angled plated 34 proximate a second lower edge 34*b*, thereof. When the screen 16 is in the fully retracted position, the first, second, third, and fourth longitudinal seals 28, 30, 36, 38 provide a highly water-resistant barrier for the garage door screen 10 that minimizes water entry into the main opening 50. If desired, a drain opening 37*a* and an attached drain pipe 37 (partially shown) can be included to drain away any water (not shown) that may enter into the main opening 50.

When the main screen assembly 12 is properly inserted in the main opening 50, the first and second angled plates 32, 34 are preferably disposed at a slight angle. The first upper edge 32*a* of the first angled plate 32 is disposed at a higher elevation than the first lower edge 32*b* of the plate 32 and the second upper edge 34*a* of the second angled plate 34 is disposed at a higher elevation than the second lower edge 34*b* of the plate 34. This ensures that if a garage door 72 (partially shown in FIG. 3) is left open and a blowing rain occurs, water will flow down off of either the first or second angled plate 32, 34 and onto the garage floor 52.

The first and second hinges 33, 35 used to attach the first upper edge 32*a* and the second upper edge 34*a* of the first and second angled plates 32, 34 to cylinder 14 provide an additional advantage. The advantage of first and second hinges 33, 35 is that as the main screen assembly 12 is lowered into the main opening 50, the angle of the first and second angled plates 32, 34 automatically adjust so that the third and fourth longitudinal seals 36, 38 always rest on the garage floor 52.

The first angled plate 32 and the second angled plate 34 also help to more evenly distribute the weight of the vehicle along a greater portion of the longitudinal length of the cylinder 14. This helps prevent damage to the cylinder 14 from occurring.

Now referring back to FIG. 1, to further ensure proper orientation of the cylinder 14 of the main screen assembly 12 within the main opening 50, a first retaining block 66*a* is provided. The first retaining block 66*a* may include any desired material and includes a size that is slightly smaller than the first vertical recess 56 provided in the main opening 50. After placement of the main screen assembly 12 into the main opening 50, the first retaining block 66*a* is placed above the first vertical recess 56 and urged down into position within the first vertical recess 56.

A second retaining block 66*b* identical to the first retaining block 66*a* is similarly urged down into the second vertical recess 58. The first and second retaining blocks 66*a*, 66*b* help to further secure the first and second square protrusions 18, 20 within the first and second vertical recesses 58, 62. The first and second retaining blocks 66*a*, 66*b* also help prevent the cylinder 14 from experiencing lateral movement and rotation while the screen 16 is extended from the main screen assembly 12.

The first retaining block 66*a* is retained in the first vertical recess 56 by the second face 14*b* of the cylinder 14, which prevents movement of the first retaining block 66*a* inward toward an interior of the main opening 50. Similarly, the second retaining block 66*b* is retained in the second vertical recess 60 by the first face 14*a* of the cylinder 14, which prevents movement of the second retaining block 66*b* inward toward the interior of the main opening 50.

As shown in FIG. 1, the first and second retaining blocks 66*a*, 66*b* are shown in an exploded view, disposed above the first and second vertical recesses 56, 58, respectively.

It is preferred that the first and second retaining blocks 66*a*, 66*b* are removable to permit access to and removal of the main screen assembly 12. Removal of the main screen assembly 12 from the main opening 50 will be described in greater detail, hereinafter.

A first ring 68*a* is preferably attached to an upper surface of the first retaining block 66*a* to facilitate removal of the first retaining block 66*a* from within the first vertical recess 56. A second ring 68*b* is preferably attached to an upper surface of the second retaining block 66*b* to facilitate removal of the second retaining block 66*b* from within the second vertical recess 60.

To remove the first retaining block 66*a*, the first ring 68*a* is grasped and urged upward thus removing the first retaining block 66*a* from within the first vertical recess 56. The second ring 68*b* of the second retaining block 66*b* is similarly grasped and the second retaining block 66*b* is urged upward and out of the second vertical recess 60.

Prior to the removal of the first and second retaining blocks 66*a*, 66*b*, the first angled plate 32 and the second angled plate 34 that are each hingedly attached to the cylinder 14 by the first and second longitudinal hinges 33, 35 are raised upward to a vertical position, as desired, to facilitate removal of the first and second retaining blocks 66*a*, 66*b*. The main screen assembly 12 can then be urged in the opposite direction of arrow 70 until the first square protrusion 18 is disposed at a bottom of the second vertical recess 60 and the second square protrusion 20 is disposed at a bottom of the first vertical recess 56. The main screen assembly 12 is then lifted upward and out of the main opening 50.

The main screen assembly 12 is removed for maintenance, repair or replacement. During use or after a long period of time, the screen 16 may become worn or damaged thereby requiring repair or replacement. It may be desired to replace the screen 16 with a new version of the screen 16 or a new version of the screen 16 that is formed of a different material. As preferred, the cylinder 14 can be designed to permit disassembly and replacement of the screen 16. Alternately, a new version of the cylinder 14 may be required when replacement of the screen 16 is necessary. Other maintenance may include cleaning the main screen assembly 12 and the main opening 50, and possibly lubricating the main screen assembly 12, as needed.

Any desired type of material can be used or substituted for the screen 16. If desired, a room darkening fabric can be used as the screen 16 to provide ventilation and privacy for activities occurring in the garage interior. Similarly, any coarseness or fineness of weave can be used for the screen 16, as well as any desired material including vinyl, fabric, aluminum mesh, stranded wire, hardware cloth, metallic fabric, composite or other materials or any other type of material that can be retracted through the slot 24 and accumulated on the center roller 22.

It is also desirable that the screen 16 provide adequate ventilation while still preventing passerby's and potential intruders from seeing the contents kept inside the garage. The screen 16 provides a formidable looking barrier that prevents entry by an intruder because the screen 16 is secured to main screen assembly 12 embedded in the garage floor 52 and therefore cannot be raised by hand. If the intruder cannot see what is kept in the garage, the intruder will have less motivation to break into the garage at that moment or at a later time.

When it is desired to raise the screen 16, the garage door 72 is first fully lowered and then a lower portion of the garage door 72 is attached (i.e., secured) to the strip 26. A first main keyhole-shaped opening, identified in general by the reference numeral 40 and a second main keyhole-shaped opening, identified in general by the reference numeral 42, are provided through a top of the strip 26 (See FIG. 2). The strip 26 includes a hollow interior.

Figure 4:
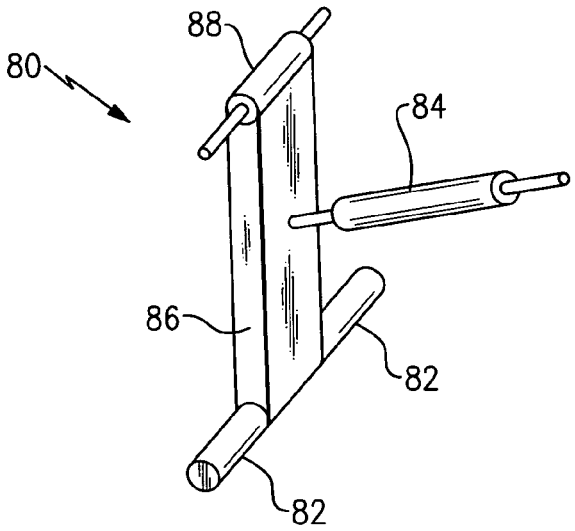
FIG. 4 is a view in perspective of a pivot assembly of the garage door screen of FIG. 2.

Referring briefly to FIG. 4, a pivot assembly, identified in general by the reference numeral 80 is shown. Two of the pivot assemblies 80 are included in the lower portion of the garage door 72. Additional pivot assemblies 80 can be included, as desired. Each pivot assembly 80 includes a retaining member 82 which enter through both of the first and second main keyhole openings 40, 42.

A solenoid 84 is included as part of the pivot assembly 80 that is energized when garage door 72 is disposed at a fully lowered position proximate the garage floor 52 and it is desired to raise (i.e., use) the screen 16. When the solenoid 84 is energized, a pivot arm 86 pivots about a top pivot hinge 88 urging the retaining member 82 under a first and a second smaller keyhole opening 40*a*, 42*a* of the first and second main keyhole openings 40, 42.

Activation of a wireless remote transmitter (not shown) or pressing a button inside the garage is accomplished when energization of the solenoid 84 (i.e., lifting of the screen 16) is desired. If the solenoid 84 is not energized when the garage door 72 is disposed in the fully lowered position, any subsequent raising of the garage door 72 will not cause the screen 16 to extend. If the solenoid 84 is not energized, the retaining members 82 will remain disposed under the first main keyhole opening 40 and the second main keyhole opening 42 until after the garage door 72 has been raised. Raising the garage door 72 when the solenoid 84 is not energized will cause the retaining members 82 to pass upward through the first and second main keyhole openings 40, 42 without affecting the position of the strip 26 or the screen 16, which remains in a fully retracted position in the cylinder 14.

Prior to raising the screen 16, the solenoid 84 is energized when the garage door 72 is disposed at fully lowered position. The energizing of the solenoid 84 causes the pivot arm 86 to pivot about the top pivot hinge 88 in direction of arrow 90 (FIG. 3). This causes the retaining members 82 to pass under the first and second smaller keyhole openings 40*a*, 42*a*. When the garage door 72 is then raised, the retaining members 82 each engage with an underside of the strip 26 thereby securing the strip 26 proximate a lower portion 72*a* (or bottom edge) of the garage door 72. The strip 26 is progressively urged upward as the garage door 72 moves upward (i.e., opens).

As the strip 26 is being raised, the screen 16 attached to the strip 26 is also progressively rising up. The screen 16 is progressively unwound off of the center roller 22 within the cylinder 14 as the garage door 72 rises.

The screen 16 is raised to any desired height by stopping the garage door 72 at any desired position above the garage floor 52. The screen 16 may fully cover the opening to the garage or the screen 16 may only be extended slightly, as desired, to provide any desired degree of ventilation to the garage interior.

If the garage door 72 is raised prior to urging the retaining members 82 of pivot assemblies 80 under the first and second smaller keyhole openings 40*a*, 42*a* on the strip 26, the screen 16 will not extend upward as the garage door 72 is raised. Instead, the retaining members 82 will simply rise up through the first and second main keyhole openings 40, 42 as the garage door 72 rises. In this manner the lower portion 72*a* of the garage door 72 is detachably-attachable with respect to the strip 26.

When the screen 16 is disposed in the fully retracted position and the garage door 72 is disposed in a fully raised position (not shown) a vehicle (not shown) can be driven in or out of the garage. When entering, the front wheels of vehicle drive over the garage floor 52, then contact the first angled plate 32, go up the first angled plate 32, over and across an upper surface of the strip 26, and then down the second angled plate 34 and back onto the other side of the garage floor 52. The process is repeated for the rear wheels. The direction of passing is reversed when the vehicle is exiting from the garage.

As mentioned previously, when the vehicle drives over the first and second angled plates 32, 34, the weight of vehicle is transferred through the main screen assembly 12 and to the first and second square protrusions 18 and 20 and finally to the garage floor 52, itself.

Figure 5:
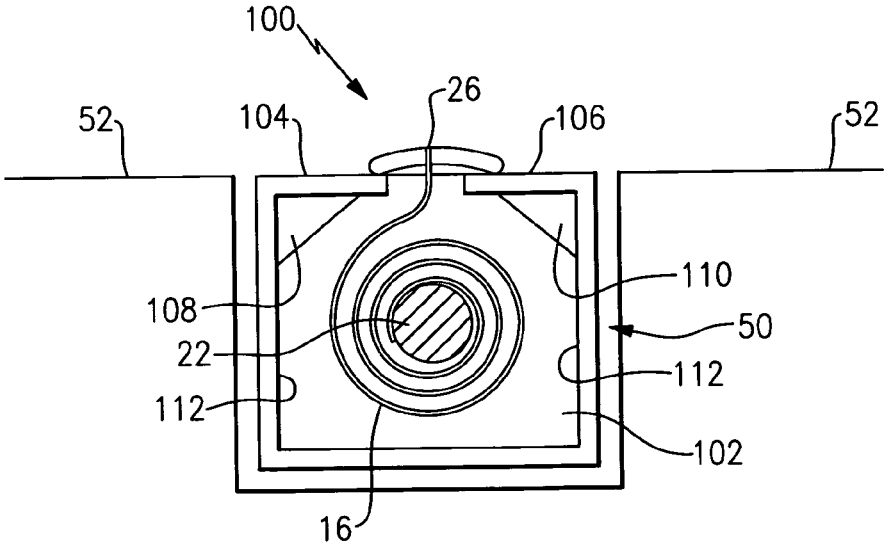
FIG. 5 is a cross-sectional view of a modified version of the garage door screen of FIG. 2.

If desired, a modified garage door screen, identified in general by the reference numeral 100, can be provided instead of the main screen assembly 12. As shown in cross-section in FIG. 5, the modified garage door screen 100 includes a modified housing 102. The modified housing 102 includes a square shape instead of the cylindrical shape of the cylinder 14. The modified housing 102 includes the screen 16 and the center roller 22 in an interior, thereof.

The modified garage door screen 100 includes a first flat plate 104 and a second flat plate 106. The first and second flat plates 104, 106 are disposed along the same horizontal plane as the garage floor 52. The strip 26 extends slightly above the plane of the first and second flat plates 104, 106. A first internal gusset 108 is provided under the first flat plate 104. A second internal gusset 110 is provided under the second flat plate 106. The first and second internal gussets 108, 110 provide additional support to the first and second flat plates 104, 106 when the vehicle passes over each of the plates 104, 106.

The modified garage door screen 100 provides a more level surface between the first and second flat plates 104, 106 and the surface of the garage floor 52. This makes driving over the modified garage door screen 100 easier to accomplish. The first and second square protrusions 18, 20 can be eliminated from the modified garage door screen 100, as desired. Heavy duty opposing vertical plates 112 can, instead, by used to transfer the weight of the vehicle directly to a bottom surface of the main opening 50. Accordingly, the first and second vertical recesses 56, 60 and the first and second horizontal recesses 58, 62 can be eliminated from the main opening 50, if the modified garage door screen 100 is used. Rotation of the modified garage door screen 100 about its center longitudinal axis cannot occur. Either the weight of the modified garage door screen 100 is sufficient to retain it in the main opening 50 as the screen 16 is urged upward or frictionally engaging wedges (not shown) can be driven between the vertical plates 112 and the interior vertical walls of the main opening 50 to secure the modified garage door screen 100 in the main opening 50.

Typically, during use of the garage door screen 10 the garage door 72 will remain in a raised position (either partially of fully) for whatever period of time use of the screen 16 is desired. Eventually, the garage door 72 with the screen 16 attached will be lowered until the garage door 72 reaches the fully lowered position. Positioning of the garage door 72 at the fully lowered position is detected by any preferred means, such as by the lower portion 72*a* of the garage door 72 interrupting a line of sight sensor (not shown). See related patent application Ser. No. 13/815,410 for additional disclosure as to sensing the position of the garage door 72.

It is preferable to automatically disengage the screen 16 apart from its attachment to the lower portion 72*a* of the garage door 72 whenever the garage door 72 reaches the fully lowered position. This ensures that whenever the garage door 72 is again raised, the screen 16 will remain in the retracted position, out of the way and not in use, unless extension of the screen 16 is again desired during the next raising of the garage door 72.

Whenever extension of the screen 72 is desired, activation of the wireless remote transmitter or pressing the button (not shown) provided in the garage is accomplished while the garage door 72 is disposed in the fully lowered position and prior to a raising of the garage door 72.

It is also desirable to provide means for aligning the position of the garage door screen 10 or the modified garage door screen 100 (or any other version of the invention) in the main opening 50 so that the strip 26 aligns with the lower portion 72*a* of the garage door 72 when the garage door 72 is disposed in the fully lowered position.

Typically, the main opening 50, as provided, is preferably somewhat larger than minimally necessary to accommodate the main screen assembly 12 and permit some movement of the main screen assembly 12 in the main opening 50. After placement of the main screen assembly 12 (or the modified garage door screen 100) in the main opening 50, the position of the main screen assembly 12 (or the modified garage door screen 100) is adjusted, as necessary, to align the strip 26 precisely under the lower portion 72*a* of the garage door 72.

Once the main screen assembly 12 (or the modified garage door screen 100) is properly positioned, the use of a thin shim 114 (FIG. 3) on one side of the main opening 50 and a thick shim 116 on an opposite side of the main opening 50 may be used to remove slack and secure the main screen assembly 12 (or the modified garage door screen 100) in a desired position. As shown, any number or thickness of the shims 114, 116 may be used to properly position the main screen assembly 12 (or the modified garage door screen 100) precisely where desired in the main opening 50.

During use, any desired thickness or quantity of the shims 114, 116 are used where desired along the longitudinal length or proximate opposite ends of the main screen assembly 12 (or the modified garage door screen 100) to skew or longitudinally displace the main screen assembly 12 (or the modified garage door screen 100) in the main opening 50, as necessary, to precisely align (i.e., dispose) the strip 26 under the lower portion 72*a* of the garage door 72.

As briefly mentioned above, additional shims (not shown) are placed at opposite ends of the main screen assembly 12 (or the modified garage door screen 100) to longitudinally displace the main screen assembly 12 (or the modified garage door screen 100) in the main opening 50, as necessary, and properly align the strip 26 within allowable tolerances under the lower portion 72*a* of the garage door 72.

Other means are also possible for aligning the main screen assembly 12 (or the modified garage door screen 100) under the lower portion 72*a* of the garage door 72. If desired, adjustment bolts 118 (FIG. 3) are provided that cooperatively engage with threaded holes provided in a base block 120. The base block 120 is preferably included as part of the main screen assembly 12 (or as a part of the modified garage door screen 100) or the base block 120 may be a separate component that is disposed under and which is used to cradle the main screen assembly 12 (or the modified garage door screen 100).

The adjustment bolts 118 are threaded and are urged either in or out of the base block 120 to skew or longitudinally shift the main screen assembly 12 (or the modified garage door screen 100) in the main opening 50 to properly align the strip 26 under the lower portion 72*a* of the garage door 72. Locking nuts 122 are preferably used to retain the adjustment bolts 118 in the desired position.

Figure 6:
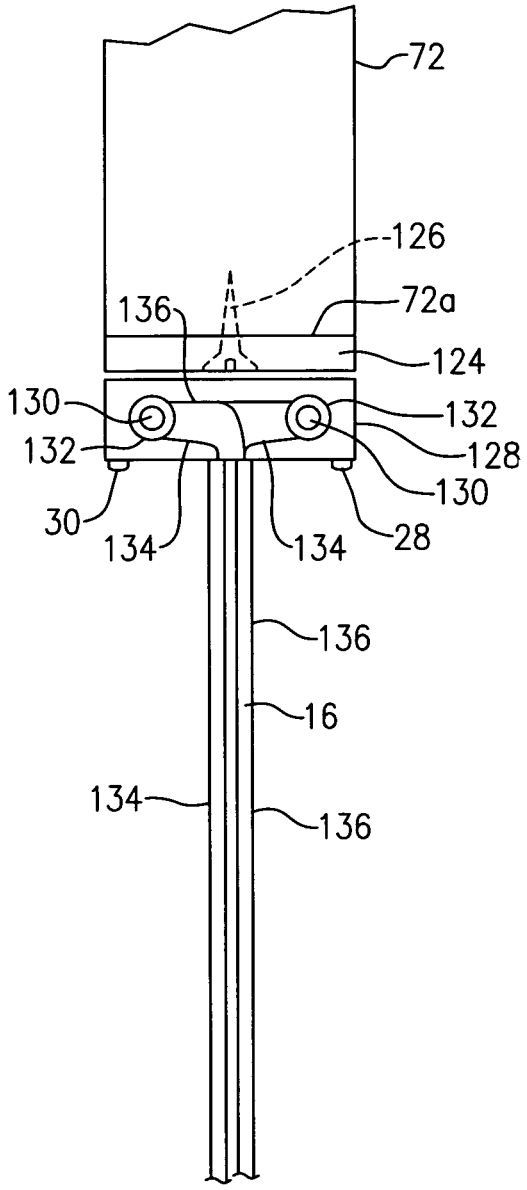
FIG. 6 is a cross-sectional view of a modified strip that electro-magnetically secures the modified strip to a lower portion of a garage door.

Referring now to FIG. 6, is shown, a steel plate 124 that is attached to the lower portion 72*a* of the garage door 72 by a plurality of fasteners 126. The steel plate 124 extends the longitudinal length of the garage door 72.

A modified strip 128 is provided that includes one or more steel rods 130 that are disposed in the modified strip 128 and which extend the longitudinal length of the modified strip 128. A conductive insulated wire coil 132 is coiled along the length of each steel rod 130.

A first conductor 134 (wire) extends upward from the main screen assembly 12 (or the modified garage door screen 100) along a first edge of the screen 16. The first conductor 134 is attached to a first end of each of the wire coils 132.

A second conductor 136 (wire) extends upward from the main screen assembly 12 (or the modified garage door screen 100) along the first edge of the screen 16 or, as desired, along an opposite second edge of the screen 16. The second conductor 136 is attached to a second end of each of the wire coils 132. The first and second conductors 134, 136 are flexible and are able to extend from or retract into the main screen assembly 12 (or the modified garage door screen 100) as the screen 16 extends or retracts.

When it is desired that the screen 16 is to be extended upward, and when the lower portion 72*a* of the garage door 72 is disposed in the fully lowered position, an electrical current passes through the first and second conductors 134, 136 which causes the steel rods 130 to each function as an electro-magnet and electro-magnetically secure the modified strip 128 to the steel plate 124 sufficient to extend the screen 16 when the garage door 72 is subsequently raised.

A significant advantage provided by the modified strip 128 is that no moving parts are required to attach or detach the modified strip 128 to the lower portion of the garage door 72. Another significant advantage is that no internal or other modification, other than attachment of the steel plate 124, is required to the garage door 72. Additionally, another significant advantage is that no electrical power or electrical connection to the garage door 72 is required. All electrical power is contained in and provided by the main screen assembly 12 (or the modified garage door screen 100), which greatly simplifies electrical connection as electrical power need only be supplied to the main screen assembly 12 (or to the modified garage door screen 100).

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A garage door screen for use with an overhead garage door and a garage floor located in a garage interior, comprising:

(a) a main screen assembly, wherein said main screen assembly includes an extensible screen, wherein said screen includes a retracted position in which said screen is maximally retracted within said main screen assembly, and an extended position in which a portion of said screen extends above the garage floor and said screen is not maximally retracted within said main screen assembly;

(b) an opening in the garage floor sufficient to receive said main screen assembly, therein;

(c) means for detachably-attaching said screen proximate a lower portion of the garage door when the garage door is disposed in a fully lowered position;

(d) wherein said main screen assembly includes a housing for storing at least a portion of said main screen, therein, and wherein said housing includes a slot that extends longitudinally across a portion of a top of said housing, and wherein said screen is able to extend out of said housing through said slot and retract into said housing through said slot;

(e) wherein said main screen assembly includes at least one plate that extends over and covers at least a portion of said opening, and wherein said plate is able to transfer a weight of a vehicle driving over said plate to said main screen assembly;

(f) wherein said plate includes a first angled plate that is hingedly attached along a first side of said first angled plate to said housing proximate a first side of said slot, and wherein said plate includes a second angled plate that is hingedly attached along a first side of said second angled plate to said housing proximate an opposite second side of said slot, and wherein said first angled plate includes an opposite second side, and wherein said second angled plate includes an opposite second side, and wherein said first side of said first angled plate is disposed at an elevation that is equal to or greater than an elevation of said second side of said first angled plate when said main screen assembly is properly disposed in said opening, and wherein said first side of said second angled plate is disposed at an elevation that is equal to or greater than an elevation of said second side of said second angled plate when said main screen assembly is disposed in said opening; and (g) wherein, when the garage door is disposed in the fully lowered position and said screen is attached to said lower portion of the garage door, and when the garage door is then raised above the fully lowered position, said screen is urged upward and out of said main screen assembly an amount that is equal to an elevation that said lower portion of the garage door is elevated above the garage floor.

2. The garage door screen of claim 1 wherein when, during use, said lower portion of the garage door is raised above the garage floor and said screen is attached to said lower portion of the garage door and wherein, during continued use, when said garage door is subsequently lowered, said means for detachably-attaching said screen proximate said lower portion of the garage door automatically detaches said screen apart from said lower portion of the garage door when the garage door reaches the fully lowered position.

3. The garage door screen of claim 2 wherein when, during further continued use, another urging of said screen upward and out of said main screen assembly is desired prior to a raising of the garage door above the fully lowered position, said means for detachably-attaching said screen proximate said lower portion of the garage door is activated sufficient to attach said screen to said lower portion of the garage door prior to the raising of the garage door.

4. The garage door screen of claim 1 wherein said main screen assembly includes a center roller, and wherein said center roller includes a spring that supplies a force to said center roller that is sufficient to retract said screen into said housing and into said retracted position when the garage door is lowered to the fully lowered position.

5. The garage door screen of claim 1 wherein an upper portion of said main screen assembly is disposed at or above a plane of the garage floor.

6. The garage door screen of claim 1 wherein said main screen assembly includes means for supporting a weight of a vehicle that is driven over the garage floor and over the main screen assembly.

7. The garage door screen of claim 6 wherein said means for supporting the weight of the vehicle includes a first protrusion that extends from a first end of said main screen assembly and a second protrusion that extends from an opposite second end of said main screen assembly, and wherein said first protrusion extends in a first recess that is provided in a first end of said opening in the garage floor, and wherein said second protrusion extends in a second recess that is provided in an opposite end of said opening in the garage floor, and wherein the weight of the vehicle is transferred through said first protrusion to a bottom of said first recess and through said second protrusion to a bottom of said second recess.

8. The garage door screen of claim 6 wherein a bottom of said housing is disposed on a bottom surface of said opening in the garage floor, and wherein the weight of the vehicle is transferred through said housing to said bottom surface of said opening.

9. The garage door screen of claim 1 including means for securing said main screen assembly in a desired position in said opening.

10. The garage door screen of claim 1 wherein said means for securing said main screen assembly in said opening includes means for permitting the removal of said main screen assembly from said opening when removal of said main screen assembly is desired.

11. The garage door screen of claim 1 including means for deterring the entry of water into said opening.

12. The garage door screen of claim 1 including means for draining water out of said opening.

13. The garage door screen of claim 1 wherein said means for detachably-attaching said screen proximate said lower portion of the garage door includes means for detachably-attaching a strip to said lower portion of the garage door, wherein said strip is attached to an upper end of said screen.

14. The garage door screen of claim 13 including a pivot assembly that is attached proximate said lower portion of the garage door, and wherein said pivot assembly includes a first position and an opposite second position and means for urging said pivot assembly from said first position to said second position and from said second position to said first position, and wherein said pivot assembly includes a retaining member that extends from said lower portion of the garage door, and wherein said retaining member is able to cooperate with said strip, and wherein when the garage door is disposed in the fully lowered position and said pivot assembly is urged into said first position, said retaining member engages with said strip an amount sufficient to raise said screen when the garage door is raised, and wherein when the garage door is disposed in the fully lowered position and said pivot assembly is urged into said second position, said retaining member does not engage with said strip an amount sufficient to raise said screen when the garage door is raised.

15. The garage door screen of claim 1 wherein said means for detachably-attaching said screen proximate said lower portion of the garage door includes a strip that is attached to an upper end of said screen, and wherein an electromagnet is disposed in said strip, and wherein when the garage door is disposed in the fully lowered position and it is desired to raise said screen, said electromagnet is energized sufficient to secure said strip to said lower portion of the garage door.

* * * * *